US010303089B2

(12) United States Patent
Maeshima

(10) Patent No.: US 10,303,089 B2
(45) Date of Patent: May 28, 2019

(54) TONER CASE, TONER SUPPLYING DEVICE AND IMAGE FORMING APPARATUS

(71) Applicant: KYOCERA Document Solutions Inc., Osaka (JP)

(72) Inventor: Masanobu Maeshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 134 days.

(21) Appl. No.: 15/492,488

(22) Filed: Apr. 20, 2017

(65) Prior Publication Data

US 2017/0322506 A1 Nov. 9, 2017

(30) Foreign Application Priority Data

May 9, 2016 (JP) ..... 2016-094093

(51) Int. Cl.
*G03G 15/08* (2006.01)

(52) U.S. Cl.
CPC ..... *G03G 15/0891* (2013.01); *G03G 15/0865* (2013.01); *G03G 15/0886* (2013.01)

(58) Field of Classification Search
None
See application file for complete search history.

(56) References Cited

U.S. PATENT DOCUMENTS 7,474,866 B2 1/2009 Doi et al.
8,620,195 B2 * 12/2013 Maeshima ..... G03G 15/0896 399/258
9,063,459 B2 6/2015 Yamanaka
2014/0270821 A1 * 9/2014 Takahashi ..... G03G 21/105 399/35

FOREIGN PATENT DOCUMENTS

JP 2006-139141 A 6/2006
JP 2011-186102 A 9/2011
JP 2012-133307 A 7/2012
JP 2014-029412 A 2/2014

OTHER PUBLICATIONS

An Office Action mailed by the Japanese Patent Office dated Dec. 4, 2018, which corresponds to Japanese Patent Application No. 2016-094093 and is related to U.S. Appl. No. 15/492,488.

* cited by examiner

*Primary Examiner* — Roy Y Yi
(74) *Attorney, Agent, or Firm* — Studebaker & Brackett PC

(57) ABSTRACT

A toner case includes a case main body, a second rotator and a case side joint. The case main body contains a toner supplied to a development device which includes a first rotator. The second rotator is disposed inside the case main body. The case side joint couples the second rotator to the first rotator. The case main body includes a case having a case side bonded area and a lid having a lid side bonded area. The lid has a lid main body, a rotator storage and a joint storage. The lid main body includes a circumferential edge around which the lid side bonded area is formed. The rotator storage extends inside the circumferential edge and stores the second rotator. The joint storage is connected to the rotator storage and formed so as to avoid the lid side bonded area. The joint storage stores the case side joint.

10 Claims, 8 Drawing Sheets

TONER CASE, TONER SUPPLYING DEVICE AND IMAGE FORMING APPARATUS

INCORPORATION BY REFERENCE

This application is based on and claims the benefit of priority from Japanese patent application No. 2016-094093 filed on May 9, 2016, which is incorporated by reference in its entirety.

BACKGROUND

The present disclosure relates to a toner case and a toner supplying device which are suitably used for a copying machine or a printer, and an image forming apparatus.

An image forming apparatus includes a development device which develops a latent image on a photosensitive drum into a toner image. A toner (a developer) supplied to the development device is contained in a toner case.

For instance, a toner storage case is arranged at a side of the development device. The toner storage case includes a screw which conveys the toner contained in a toner storage part to the development device. The screw is arranged at an upper face of the toner storage part. To the screw, a second joint coupled to a first joint of the development device is fixed. A drive source of the development device rotates the screw via the both joints.

SUMMARY

In accordance with an aspect of the present disclosure, a toner case includes a case main body, a second rotator and a case side joint. The case main body contains a toner supplied to a development device which includes a first rotator rotating around a first rotation axis. The second rotator is disposed inside the case main body and rotating around a second rotation axis extending in a direction along the first rotation axis. The case side joint is capable of coupling one end of the second rotator to an end of the first rotator. The case main body includes a case and a lid. The case has a case side bonded area formed around an outer circumference of an opening formed at one face of the case. The lid has a lid side bonded area corresponding to the case side bonded area. The lid seals the case in a state where the lid side bonded area is bonded to the case side bonded area. The lid has a lid main body, a rotator storage and a joint storage. The lid main body includes a circumferential edge around which the lid side bonded area is formed. The rotator storage extends in a direction along the second rotation axis inside the circumferential edge of the lid main body. The rotator storage is capable of storing the second rotator. The joint storage is connected to one end of the rotator storage and formed inside the circumferential edge of the lid main body so as to avoid the lid side bonded area. The joint storage is capable of storing the case side joint.

In accordance with an aspect of the present disclosure, a toner supplying device includes the toner case and the development device. To the development device, the toner is supplied from the toner case. The development device has a development side joint formed on the end of the first rotator. The case side joint and the development side joint are engaged with each other so that rotation is transmitted between the first rotator and the second rotator.

In accordance with an aspect of the present disclosure, an image forming apparatus includes the toner supplying device.

In accordance with one aspect of the present disclosure, an image forming apparatus includes the toner case and an image forming part. The image forming part has the development device which forms a toner image using the toner supplied from the toner case.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a preferable embodiment of the present disclosure will be described.

Figure 1:
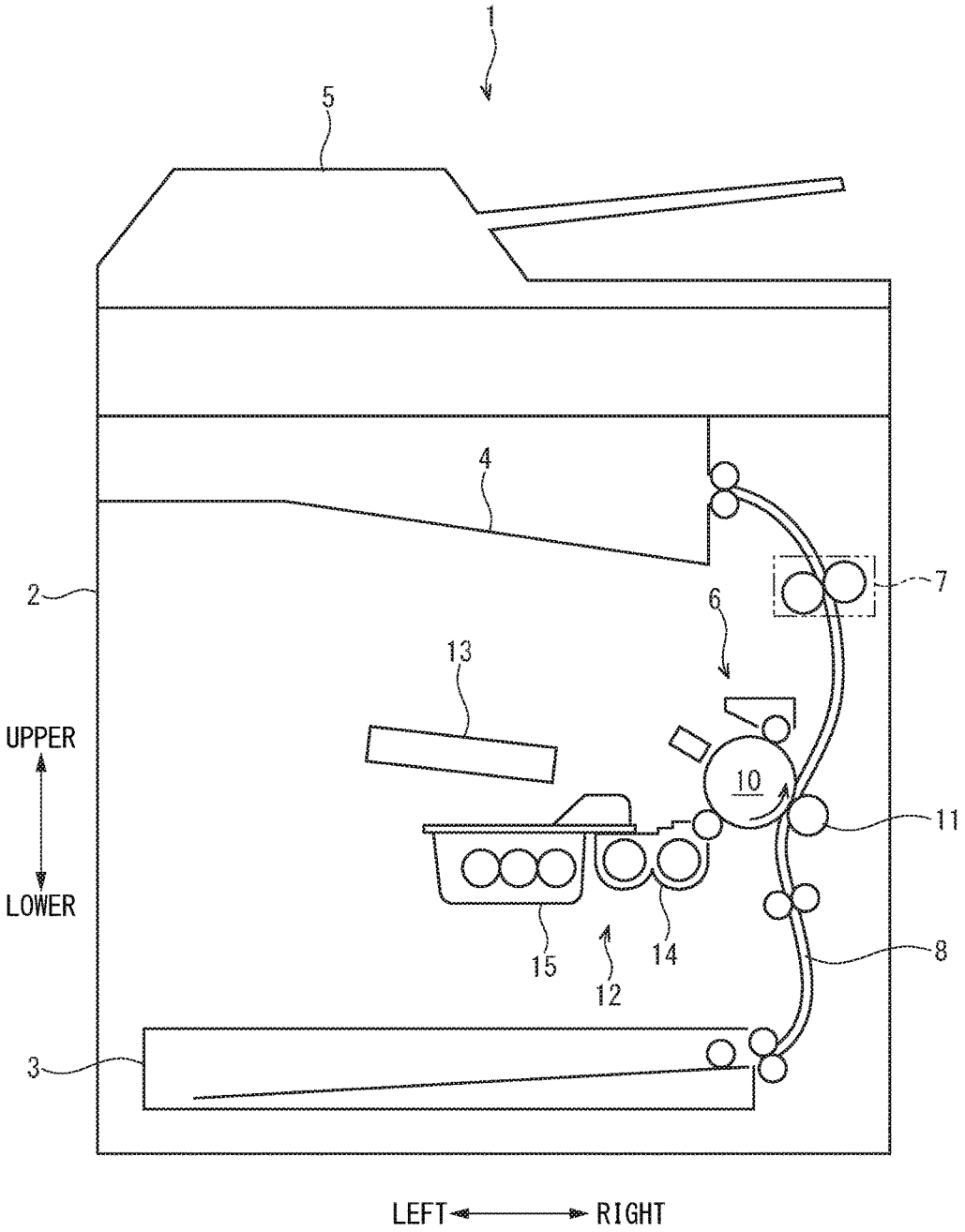
FIG. 1 is a sectional view schematically showing an inner structure of an image forming apparatus according to an embodiment of the present disclosure.

With reference to FIG. 1, an entire structure of an image forming apparatus 1 will be described. FIG. 1 is a sectional view schematically showing an inner structure of the image forming apparatus 1. In the following descriptions, a near side of the paper plan of FIG. 1 is set as a front side of the image forming apparatus 1, and the descriptions are based on directions shown in each figure.

The image forming apparatus 1, such as a multifunctional peripheral, prints an image input from an external device on a sheet. The image forming apparatus 1 employs an electrophotographic manner as a printing manner. In a lower portion of an apparatus main body 2 of the image forming apparatus 1, a sheet feeding cassette 3 is provided. In an upper portion of the apparatus main body 2, an ejection tray 4 is provided. Above the ejection tray 4, an image reading part 5 which reads image information on a document is provided. The image forming apparatus 1 may be a printer, a copying machine, a facsimile or the like.

The image forming apparatus 1 includes an image forming part 6 and a fixing device 7 in the apparatus main body 2. The image forming part 6 is disposed on the middle of a conveying path 8 extending from the sheet feeding cassette 3 to the ejection tray 4. The fixing device 7 is disposed on a downstream side of the conveying path 8.

The image forming part 6 has a photosensitive drum 10, a transferring roller 11, a toner supplying device 12 and an optical scanning device 13. The transferring roller 11 comes into contact with the photosensitive drum 10 to form a transferring nip. The toner supplying device 12 has a development device 14, a toner container 15 and the others, described later in detail. The toner container 15 as an example of a toner case contains a toner (a developer). The toner is supplied to the development device 14 from the toner container 15. The toner may be a one-component developer including a magnetic toner or a two-component developer including a toner and a carrier.

The toner container 15 is arranged at a left side of the development device 14. The optical scanning device 13 is arranged above the toner container 15. The optical scanning device 13 exposes the photosensitive drum 10 to form a latent image. The development device 14 develops the latent image into a toner image using a toner supplied from the toner container 15. The toner image carried on the photosensitive drum 10 is transferred on the sheet passing through the transferring nip and then fixed on the sheet by the fixing device 7. Then, the sheet is ejected toward the ejection tray 4.

Figure 2:
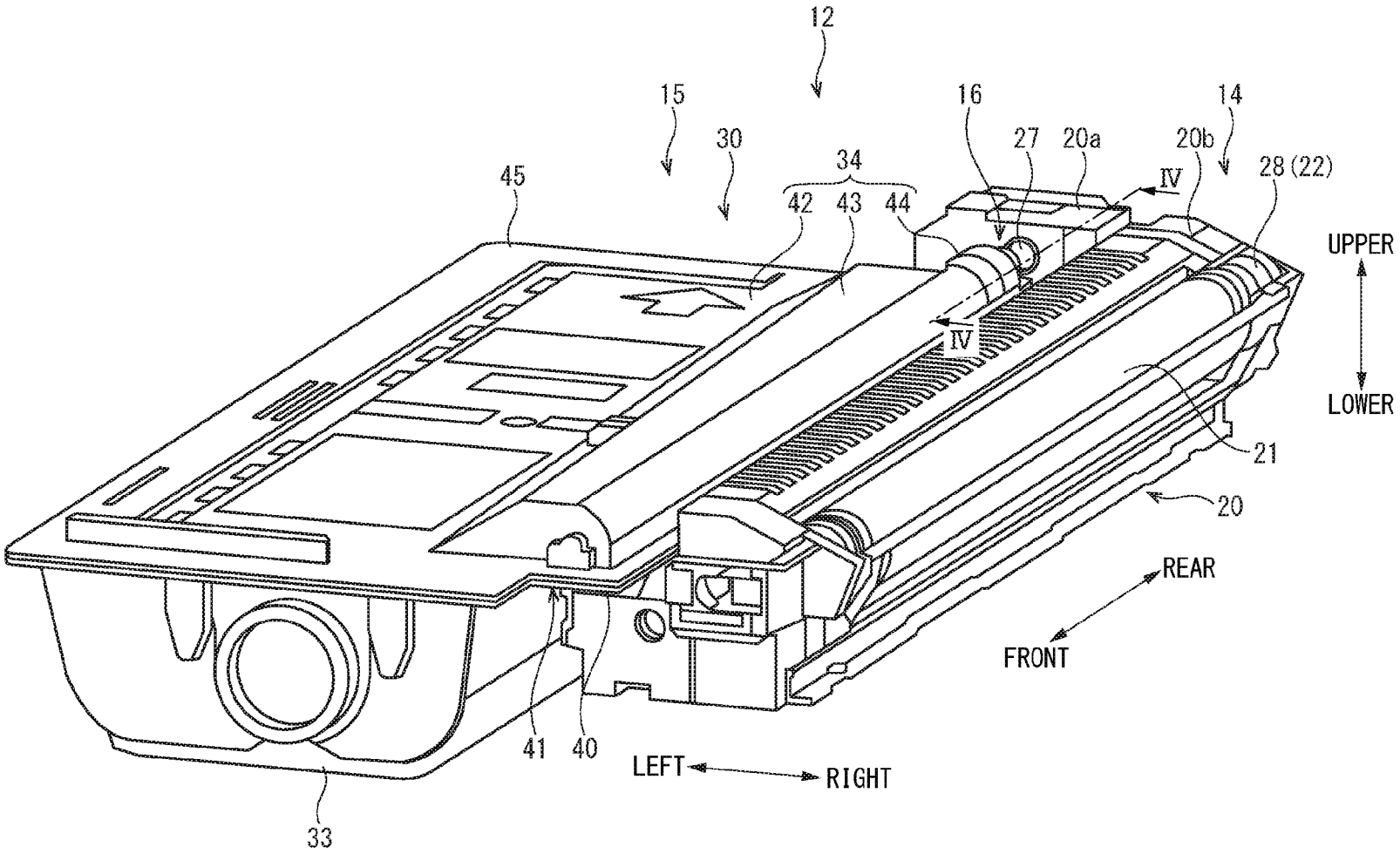
FIG. 2 is a perspective view showing a toner supplying device according to the embodiment of the present disclosure.
Figure 3:
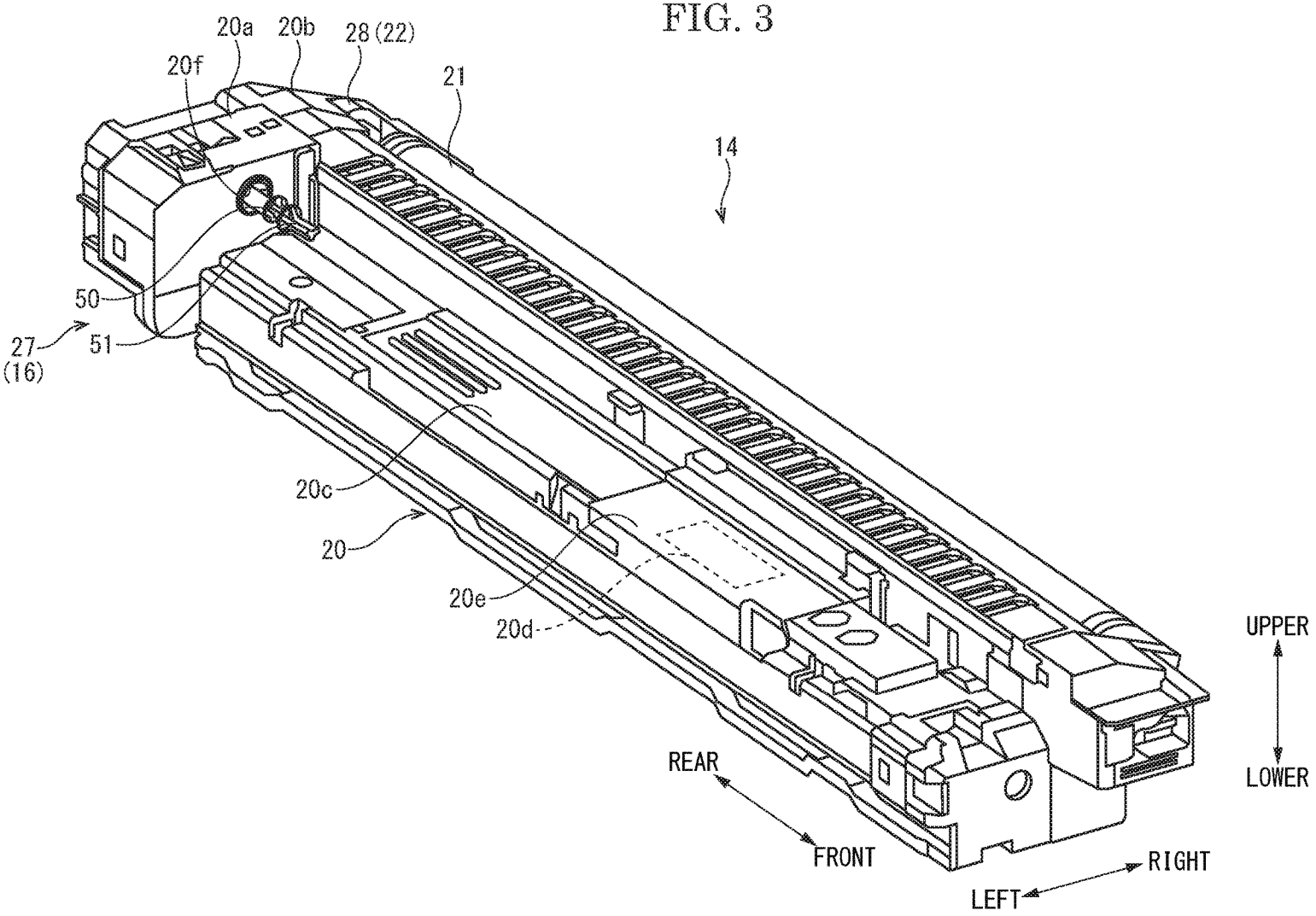
FIG. 3 is a perspective view showing a development device according to the embodiment of the present disclosure.
Figure 4:
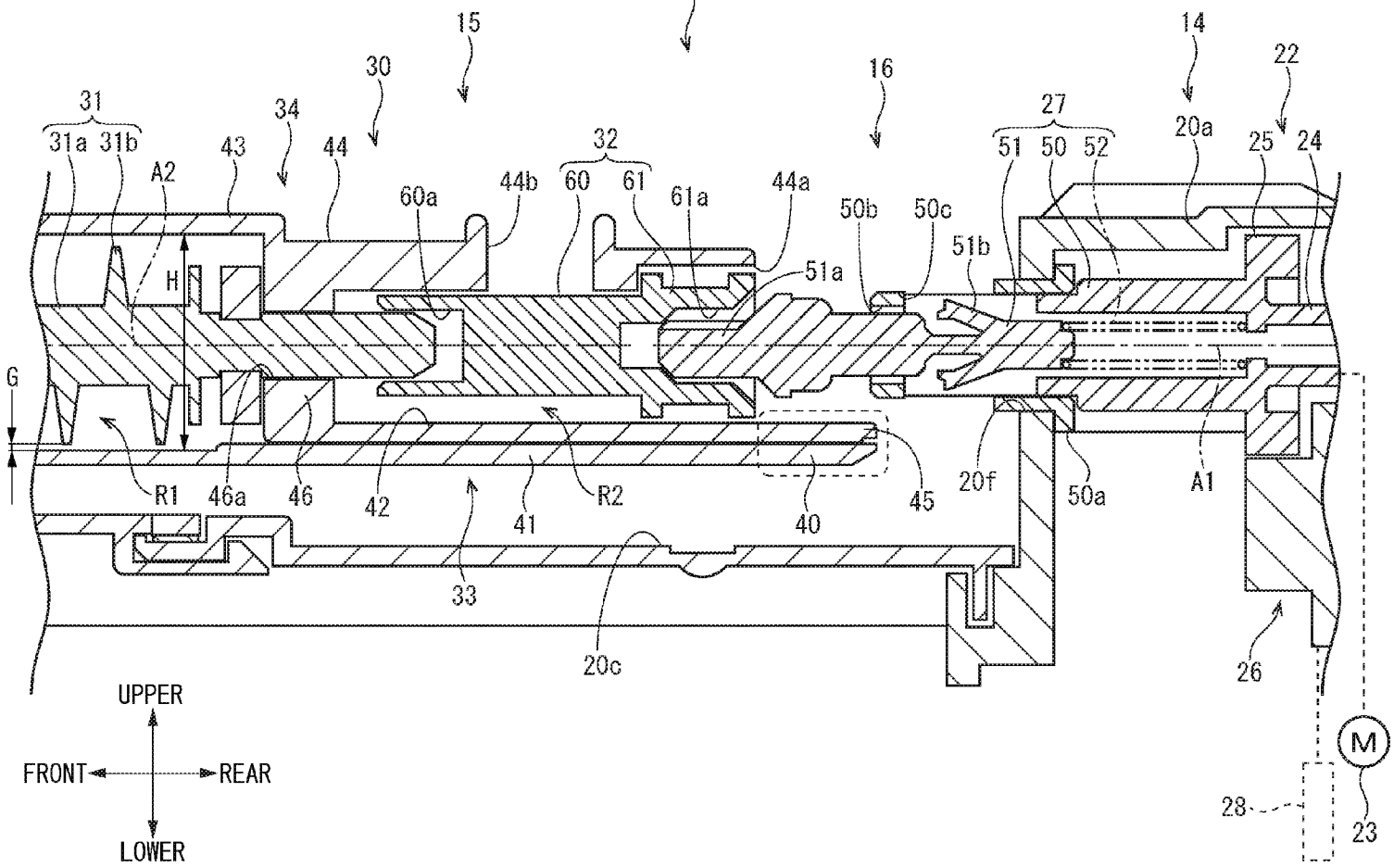
FIG. 4 is a sectional view taken along a line IV-IV of FIG. 2.
Figure 5:
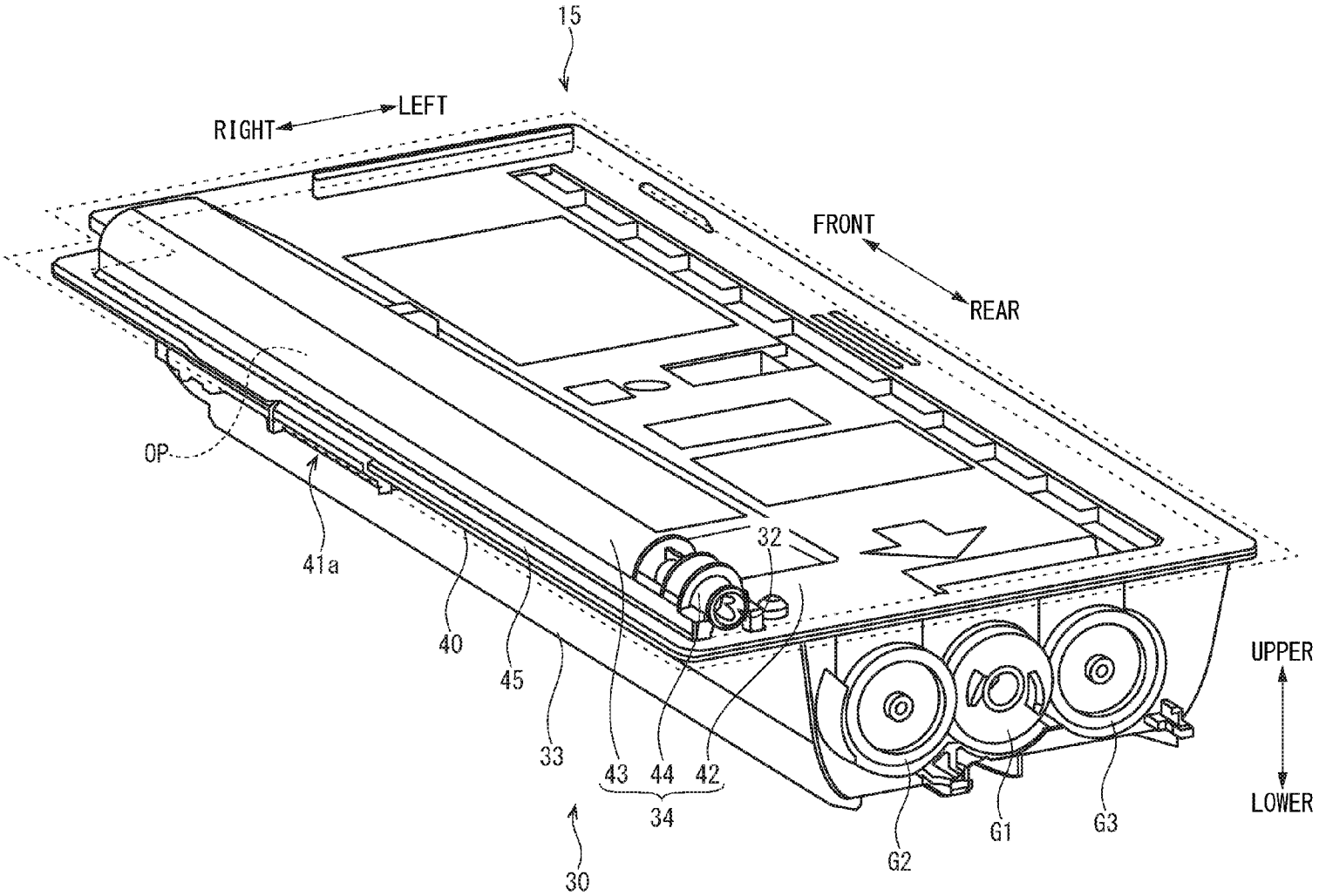
FIG. 5 is a perspective view showing a toner container according to the embodiment of the present disclosure.
Figure 6:
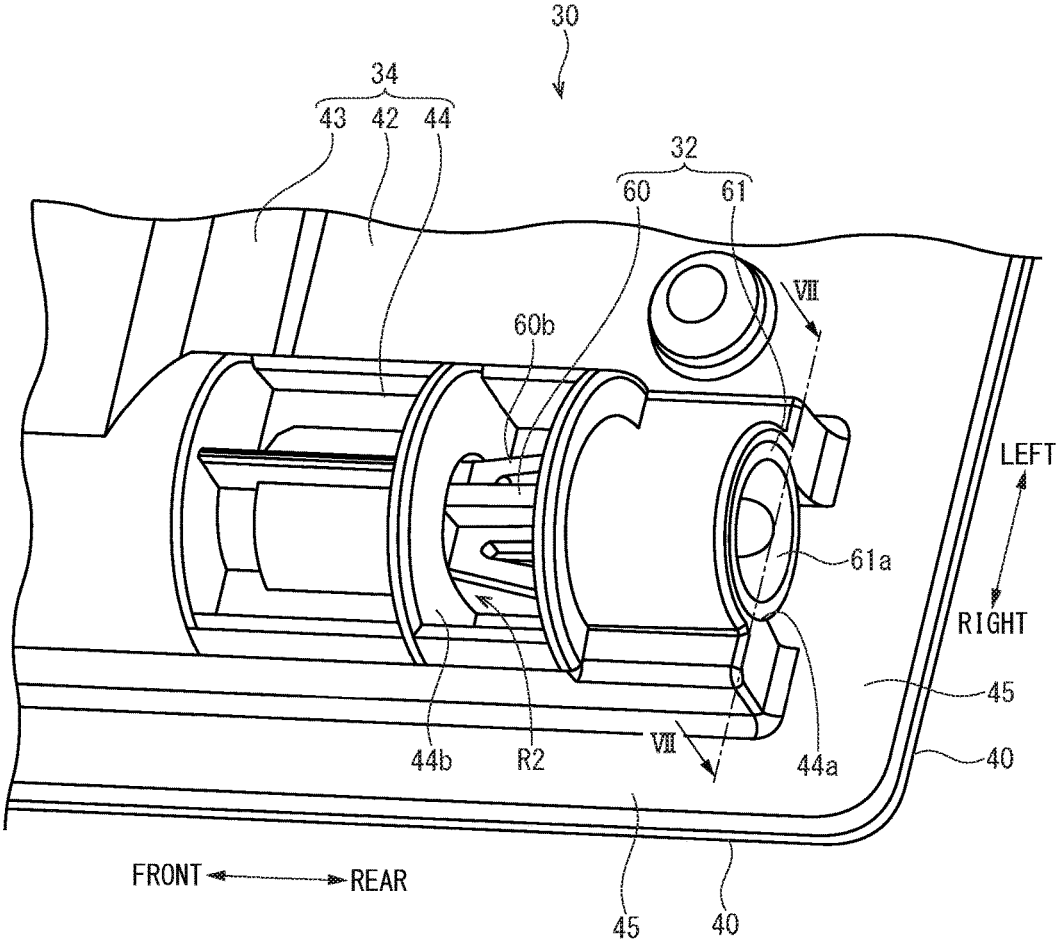
FIG. 6 is a perspective view showing a part of a lid of the toner container according to the embodiment of the present disclosure.
Figure 7:
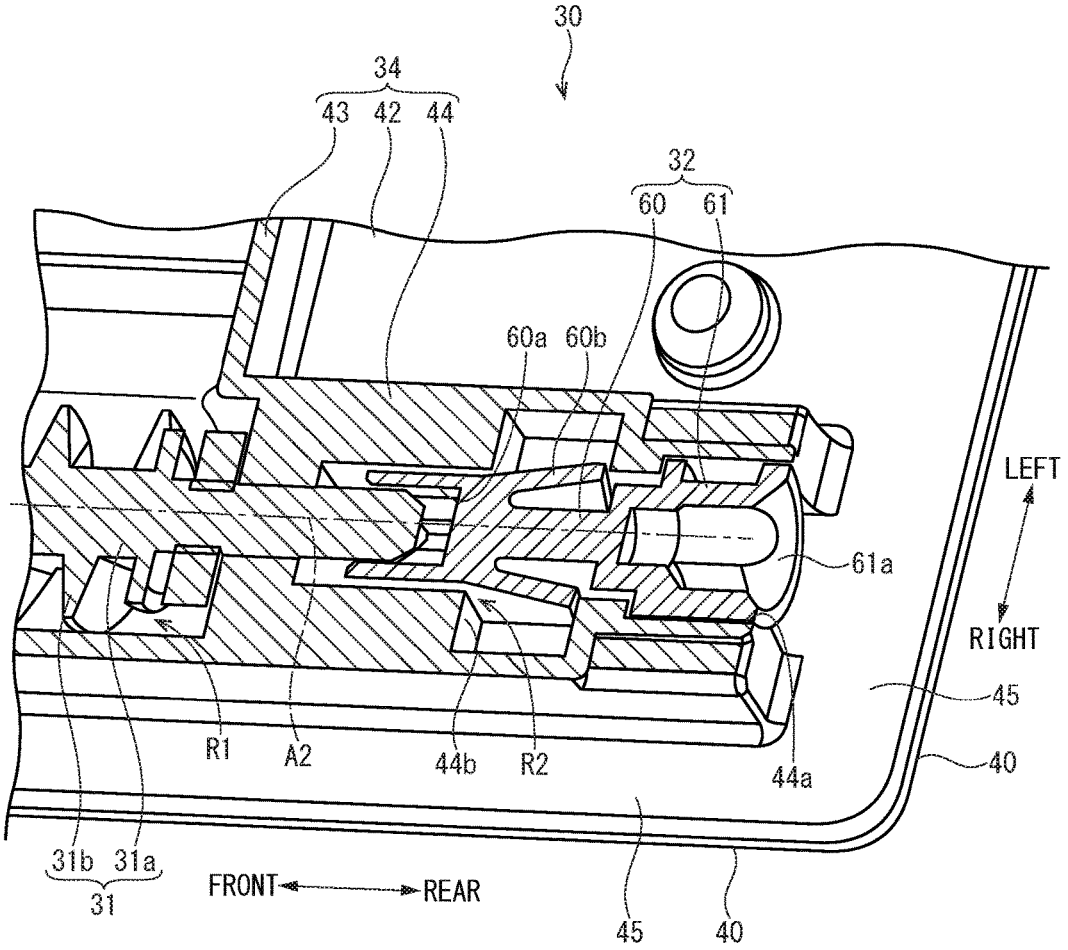
FIG. 7 is a sectional view taken along a line VII-VII of FIG. 6.

Next, with reference to FIG. 2 to FIG. 7, the toner supplying device 12 will be described. FIG. 2 is a perspective view showing the toner supplying device 12. FIG. 3 is a perspective view showing the development device 14. FIG. 4 is a sectional view taken along a line IV-IV of FIG. 2. FIG. 5 is a perspective view showing the toner container 15. FIG. 6 is a perspective view showing a part of a lid 34 of the toner container 15. FIG. 7 is a sectional view taken along a line VII-VII of FIG. 6.

As shown in FIG. 2, the toner supplying device 12 includes the development device 14, the toner container 15 and a coupling mechanism 16. The toner container 15 is detachably attached to the apparatus main body 2. The development device 14 and the toner container 15 are adjacently arranged side by side. This arrangement makes the toner supplying device 12 lower in height. Accordingly, even if the optical scanning device 13 is arranged above the toner container 15, the image forming apparatus 1 (the apparatus main body 2) can be made small in size (refer to FIG. 1).

As shown in FIG. 2 and FIG. 3, the development device 14 has a housing 20, a development roller 21 and a development drive mechanism 22.

The housing 20 is formed into a box-shape elongated in the front and rear direction, and made of synthetic resin, for example. In the housing 20, the toner is stored. On an upper portion of the housing 20, a rear side protruded part 20*a* and a right side protruded part 20*b* are formed. As shown in FIG. 3, on a left upper face of the housing 20, a connecting face 20*c* lowered by one step than each of the protruded parts 20*a* and 20*b* is formed. In the connecting face 20*c* of the housing 20, a replenishment port 20*d* into which the toner is supplied from the toner container 15 is formed. The replenishment port 20*d* is covered by a replenishment shutter 20*e* slidably supported by the housing 20.

As shown in FIG. 2 and FIG. 3, the development roller 21 is formed into a cylindrical shape elongated in the front and rear direction. The development roller 21 is supported in the right side protruded part 20*b* so as to be rotatable in a state where a part of the development roller 21 is exposed. The toner in the housing 20 adheres to the development roller 21 and then is transferred on the photosensitive drum 10 to form the toner image. Inside the housing 20, a development side agitating member and the others (not shown) which agitate the toner are supported so as to be rotatable.

As shown in FIG. 3 and FIG. 4, the development drive mechanism 22 has a drive motor 23, a drive shaft 24, a drive gear 25, a driven gear train 26 and a development side joint 27. The development drive mechanism 22 is provided in order to rotate the development roller 21, the development side agitating member and the others.

The drive motor 23 is connected to the drive shaft 24 via a gear train (not shown). The drive shaft 24 as an example of a first rotator is formed into a cylindrical shape elongated in the front and rear direction, and supported in the rear side protruded part 20*a* so as to be rotatable around a first rotation axis A1 extending in the front and rear direction. The drive gear 25 is formed integrally with a front portion of the drive shaft 24. The driven gear train 26 is meshed with the drive gear 25, an output gear 28 (refer to FIG. 3) fixed to the development roller 21 and a gear (not shown) of the development side agitating member. Drive force (rotation) of the drive motor 23 is transmitted to the development roller 21 and the others via the drive gear 25 and the driven gear train 26. The development side joint 27 is provided on a front end portion (the other end portion) of the drive shaft 24, as described later in detail.

As shown in FIG. 2, FIG. 4 and FIG. 5, the toner container 15 has a case main body 30, a conveying screw 31 and a case side joint 32. The case main body 30 is capable of containing the toner which is supplied to the development device 14. The conveying screw 31 as an example of a second rotator is provided in order to convey the toner contained in the case main body 30 toward the development device 14. The case side joint 32 is capable of coupling a rear end portion (one end portion) of the conveying screw 31 to the front end portion (the other end portion) of the drive shaft 24.

As shown in FIG. 2 and FIG. 5, the case main body 30 has a case 33 and a lid 34. The case main body 30 is formed into a box-shape, and made of thermoplastic resin, for example.

The case 33 is formed into a bathtub-like shape elongated in the front and rear direction. The case 33 has an opening OP on its upper face. Inside the case 33, a toner storage room (not shown) in which the toner is contained is formed. The case 33 has a case side bonded area 40 around an outer circumference of the opening OP (refer to a dashed line in FIG. 5). The case side bonded area 40 is formed into a flange-shape extending outward from four upper edges of the case 33. The right side case side bonded area 40 is formed on a tip side of a connecting flange portion 41 extending rightward from a right upper edge of the case 33 (refer to FIG. 2 and FIG. 4). That is, a width of one flange-shape formed at a right edge is wider than that of another flange-shape formed at another edge.

When the toner container 15 is attached to a predetermined position of the apparatus main body 2, the right side case side bonded area 40 and the connecting flange portion 41 are overlapped on the connecting face 20*c* of the development device 14 (refer to FIG. 2 and FIG. 4). The connecting flange portion 41 has a discharge port (not shown) at a position corresponding to the replenishment port 20*d* of the development device 14. The discharge port is covered with a discharge shutter 41*a* slidably supported by the connecting flange portion 41 (refer to FIG. 5). The replenishment shutter 20*e* and the discharge shutter 41*a* are configured to be opened by linking an attachment operation of the toner container 15 to the apparatus main body 2.

As shown in FIG. 2 and FIG. 5, the lid 34 covers the opening OP of the case 33. The lid 34 has a lid side bonded area 45 corresponding to the case side bonded area 40 (refer to the dashed line in FIG. 5). The lid 34 has a lid main body 42, a rotator storage 43 and a joint storage 44. The lid main body 42, the rotator storage 43 and the joint storage 44 are integrally formed.

The lid main body 42 is formed into a plate-like shape elongated in the front and rear direction. Around a circumferential edge of the lid main body 42, the lid side bonded area 45 is formed. In a state where the lid side bonded area 45 is bonded to the case side bonded area 40, the lid 34 seals the case 33.

The rotator storage 43 is swelled upward at the right side portion of the lid main body 42. As shown in FIG. 4, a lower face of the rotator storage 43 is opened. The rotator storage 43 extends in the front and rear direction (a direction along the second rotation axis A2) inside the circumferential edge of the lid main body 42 so as to avoid the lid side bonded area 45. The rotator storage 43 is formed so as to be able to store the conveying screw 31. A right side portion of an inside of the rotator storage 43 forms a screw arrangement room R1 in which the conveying screw 31 is arranged.

In a state where the lid 34 is bonded to the case 33, a right side portion of the rotator storage 43 (the screw arrangement room R1) is positioned above the connecting flange portion 41. A left side portion of the rotator storage 43 is positioned above the toner storage room, and the screw arrangement room R1 is communicated with the toner storage room. Because the rotator storage 43 is opened on the lower face, an upper face of the connecting flange portion 41 is a bottom face (a floor face) of the screw arrangement room R1. A height H (a distance between a top face and the bottom face) of the screw arrangement room R1 is substantially constant in the front and rear direction. That is, the rotator storage 43 is formed so as to be parallel with the connecting flange portion 41 (the case side bonded area 40) or the lid side bonded area 45.

As shown in FIG. 5 and FIG. 6, the joint storage 44 is formed into a substantially cylindrical shape extending in the front and rear direction on an upper face of the lid main body 42. The joint storage 44 is connected to a rear end portion of the rotator storage 43 (the screw arrangement room R1). The joint storage 44 is formed inside the circumferential edge of the lid main body 42 so as to avoid the lid side bonded area 45. In detail, the joint storage 44 is formed at a portion avoiding the rear side and the right side of the lid side bonded area 45. In addition, in a state where the lid 34 is bonded to the case 33, the joint storage 44 is positioned above the connecting flange portion 41 (refer to FIG. 4).

As shown in FIG. 4 and FIG. 6, the joint storage 44 is formed so as to be able to store the case side joint 32. Inside the joint storage 44, a joint arrangement room R2 in which the case side joint 32 is arranged is formed. Because the joint storage 44 is formed on the lid main body 42, the upper face of the lid main body 42 forms a bottom face (a floor face) of the joint arrangement room R2. On a rear end face (one end face) of the joint storage 44, an insertion opening 44*a* opened to the joint arrangement room R2 is formed. At a middle portion of the joint storage 44 in the front and rear direction, a hook engagement opening 44*b* (a hook engagement part) opened to the joint arrangement room R2 is formed. A partition wall 46 between the joint arrangement room R2 and the screw arrangement room R1 has a through hole 46*a* (refer to FIG. 4).

Inside the case main body 30, two case side toner agitating members and the others are rotatably supported (not shown). As shown in FIG. 5, on a rear side face of the case 33, an intermediate gear G1 connected to a motor (not shown) is provided. The intermediate gear G1 is meshed with two output gears G2 and G3 fixed to the corresponding case side toner agitating members. The motor rotates the two case side toner agitating members via the plurality of gears G1 to G3.

As shown in FIG. 4, the conveying screw 31 has a screw shaft 31*a* extending in the front and rear direction and a screw blade 31*b* spirally fixed around the screw shaft 31*a*. The conveying screw 31 is arranged in the screw arrangement room R1, and supported between a front side wall of the rotator storage 43 and the partition wall 46. The conveying screw 31 is rotatable around the second rotation axis A2 extending in the front and rear direction (a direction along the first rotation axis A1). The conveying screw 31 is supported in the rotator storage 43 in a posture parallel with the case side bonded area 40 or the lid side bonded area 45. Accordingly, a gap G between the screw blade 31*b* of the conveying screw 31 and the bottom face of the screw arrangement room R1 (the upper face of the connecting flange portion 41) is substantially constant in the front and rear direction.

A rear end portion of the screw shaft 31*a* penetrates through the through hole 46*a* of the partition wall 46 and extends to an inside of the joint storage 44 (the joint arrangement room R2). A rear end face of the screw shaft 31*a* is positioned in front of the hook engagement opening 44*b*. The case side joint 32 is provided at the rear end portion (one end portion) of the conveying screw 31.

As shown in FIG. 4, the coupling mechanism 16 is constituted by the development side joint 27 of the development device 14 and the case side joint 32 of the toner container 15. The coupling mechanism 16 couples the development side joint 27 to the case side joint 32 so as to transmit the rotation between the drive shaft 24 and the conveying screw 31.

The development side joint 27 includes a development side main body 50, a development side engagement member 51 and a coil spring 52.

The development side main body 50 is formed integrally with the drive shaft 24. The development side main body 50 extends forward from the front end portion of the drive shaft 24. The development side main body 50 is formed into a substantially cylindrical shape coaxial with the first rotation axis A1. A rear side portion of the development side main body 50 is disposed inside the rear side protruded part 20*a*. A front side portion of the development side main body 50 penetrates through a through opening 20*f* formed in a front side wall of the rear side protruded part 20*a*, and extends forward. The development side main body 50 is rotatably supported by the through opening 20*f* via a sleeve 50*a*. That is, the development side main body 50 is provided so as to be rotatable integrally with the drive shaft 24.

In a front end face of the development side main body 50, an end opening 50*b* opened to the inside is formed. On an outer circumferential face of the front side portion of the development side main body 50, a pair of development side grooves 50*c* elongated in the front and rear direction is formed. The development side grooves 50*c* are formed at positions displaced in the circumferential direction by 180 degrees (at opposing positions). The number of the development side groove 50*c* may be one or more.

The development side engagement member 51 is formed into a substantially rod shape elongated in the front and rear direction. A rear side portion of the development side engagement member 51 is loosely inserted in an inner space of the development side main body 50 through the end opening 50*b*. A front side portion of the development side engagement member 51 extends outward (forward) from the development side main body 50 through the end opening

50*b*. On a front end portion of the development side engagement member 51, an engagement tip end 51*a* is formed. The engagement tip end 51*a* is branched into three radial directions from the center (not shown).

On a rear face of the development side engagement member 51, a pair of development side hook portion 51*b* is formed at a position corresponding to the pair of development side groove 50*c*. Each development side hook portion 51*b* extends from an outer circumferential face of the development side engagement member 51 outward in a radial direction perpendicular to the first rotation axis A1. Each development side hook portion 51*b* extends from the outer circumferential face of the development side engagement member 51 in a front oblique direction. Each development side hook portion 51*b* is elastically deformable in the radial direction. The development side hook portions 51*b* are loosely engaged with the development side grooves 50*c*. In a state where each development side hook portion 51*b* is engaged with each development side groove 50*c*, the development side engagement member 51 is prevented from being rotated with respect to the development side main body 50. The development side engagement member 51 is movable in the front and rear direction in a range of a length of each development side groove 50*c* and inclinable with respect to the first rotation axis A1.

The coil spring 52 as an example of a biasing member is compressed between a bottom face of the inner space of the development side main body 50 and a front end face of the development side engagement member 51. The coil spring 52 biases the development side engagement member 51 forward. A plate spring or an elastic deformable rubber may be employed as the biasing member, instead of the coil spring 52.

As shown in FIG. 4, FIG. 6 and FIG. 7, the case side joint 32 is inserted into the joint storage 44 though the insertion opening 44*a*. The case side joint 32 includes a case side main body 60 and a case side engagement member 61.

As shown in FIG. 4 and FIG. 7, the case side main body 60 is formed into a substantially rod shape elongated in the front and rear direction. On a front end face of the case side main body 60, a fitting opening 60*a* into which the rear end portion of the screw shaft 31*a* is fitted is formed. In a state where the case side joint 32 is stored in the joint storage 44, the rear end portion of the screw shaft 31*a* is extended into the joint storage 44 and fitted into the fitting opening 60*a* so as not to be rotatable. That is, the case side main body 60 is rotatable integrally with the conveying screw 31. In this state, the case side joint 32 is detachably coupled to the rear end portion of the conveying screw 31.

As shown in FIG. 6 and FIG. 7, the case side main body 60 has a pair of case side hook portion 60*b* at a position corresponding to the hook engagement opening 44*b* of the joint storage 44. Each case side hook portion 60*b* extends from an outer circumferential face of the case side main body 60 outward in a radial direction perpendicular to the second rotation axis A2. Each case side hook portion 60*b* extends from the outer circumferential face of the case side main body 60 in a rear oblique direction. Each case side hook portion 60*b* is elastically deformable in the radial direction. In a state where the case side joint 32 is stored inside the joint storage 44, the case side hook portions 60*b* are loosely engaged with the hook engagement opening 44*b*. The engagement of each case side hook portion 60*b* with the hook engagement opening 44*b* (a rear edge portion of the hook engagement opening) can prevent the case side joint 32 from being detached from the joint storage 44. Thereby, the case side joint 32 can be made to be supported by the joint storage 44. The case side joint 32 is supported in the joint storage 44 so as to be rotatable around the second rotation axis A2.

The case side engagement member 61 is connected to a rear end portion of the case side main body 60. The case side engagement member 61 has an engagement recess 61*a* opened to a side of the development side joint 27. With the engagement recess 61*a*, the engagement tip end 51*a* of the development side engagement member 51 is detachably engaged. That is, the engagement recess 61*a* has a shape corresponding to the engagement tip end 51*a*, and is recessed on a rear end face of the case side engagement member 61.

In a state where the case side joint 32 is inserted into the joint storage 44 and coupled to the conveying screw 31, the case side joint 32 does not protrude outside (rearward) through the insertion opening 44*a* (the rear end face) of the joint storage 44. In detail, the rear end face of the case side engagement member 61 is positioned on the same face as an opened face of the insertion opening 44*a*. In this way, the case side joint 32 has a size (a length) enabling an entire of the case side joint 32 to be stored in the joint storage 44. That is, the case side joint 32 is also arranged so as to avoid the lid side bonded area 45. The rear end face of the case side joint 32 may be positioned inside (forward) or outside the opened face of the insertion opening 44*a*.

Figure 8:
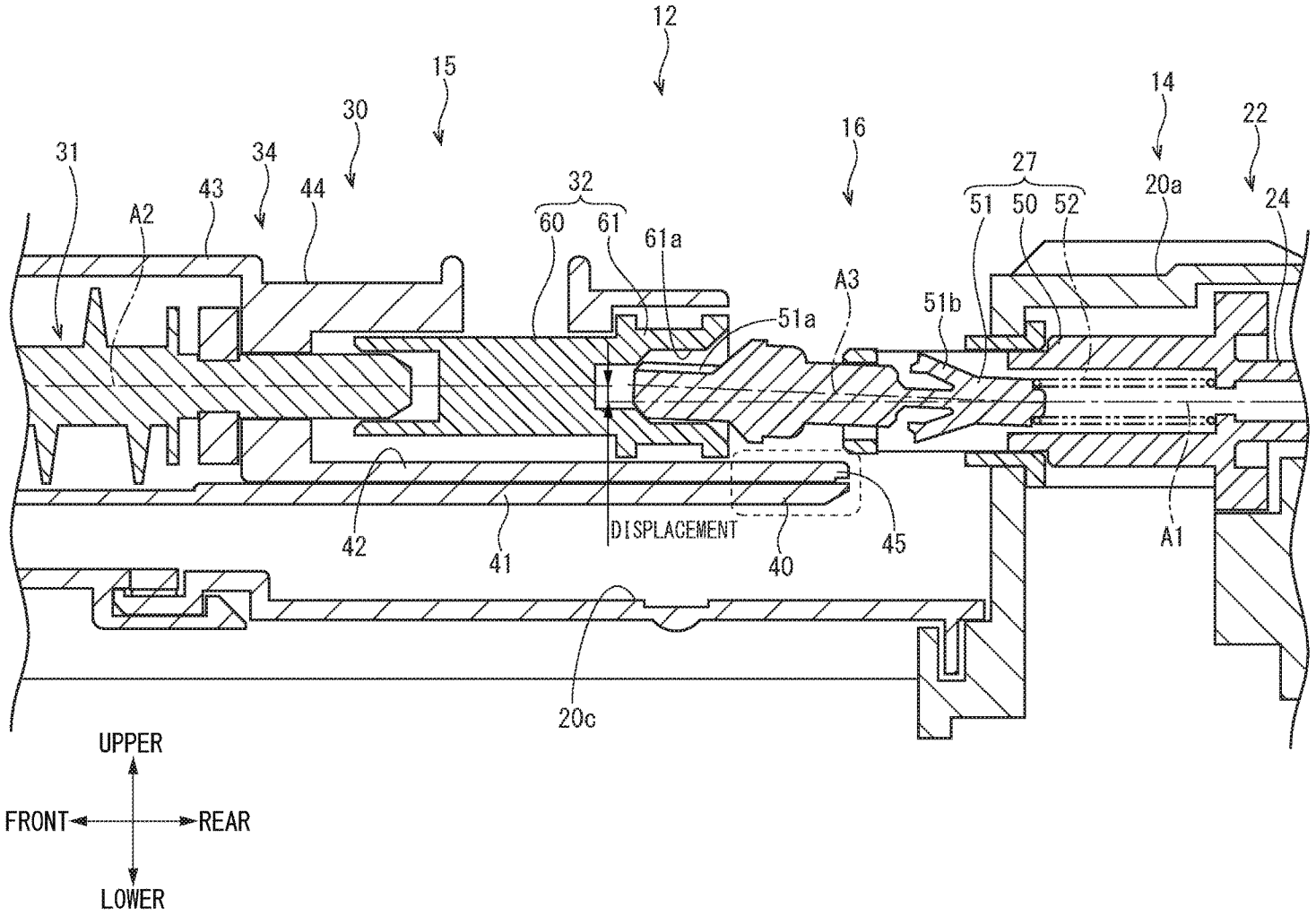
FIG. 8 is a sectional view explaining an operation of a coupling mechanism of the toner container according to the embodiment of the present disclosure.

Next, with reference to FIG. 4 and FIG. 8, an operation of the coupling mechanism 16 will be described. FIG. 8 is a sectional view explaining the operation of the coupling mechanism 16.

When the development side joint 27 and the case side joint 32 are not engaged, the development side engagement member 51 of the development side joint 27 is biased by the coil spring 52. Thereby, a tip end portion (a front end face) of each development side hook portion 51*b* of the development side engagement member 51 comes into pressure contact with a front edge portion of each development side groove 50*c* of the development side main body 50. In this state, the development side main body 50 and the development side engagement member 51 is maintained in a posture along the first rotation axis A1 (refer to FIG. 4).

Next, a case where the toner container 15 is attached to the apparatus main body 2 (coupled to the development device 14) will be described. As shown in FIG. 4, when the first rotation axis A1 and the second rotation axis A2 are on the substantially same axis, the engagement tip end 51*a* of the development side joint 27 (the development side engagement member 51) is smoothly fitted into (engaged with) the engagement recess 61*a* of the case side joint 32 (the case side engagement member 61). Because the engagement tip end 51*a* is fitted into the engagement recess 61*a* so as not to be rotatable, the drive force of the drive motor 23 is transmitted to the conveying screw 31 from the drive shaft 24. As described above, the toner container 15 (the case side joint 32) is coupled to the development device 14 (the development side joint 27).

When the toner container 15 is coupled to the development device 14, each of the shutters 20*e* and 41*a* is opened and the discharge port is connected to the replenishment port 20*d* (not shown). The toner in the toner container 15 is replenished to the development device 14 (the housing 20) through the discharge port and the replenishment port 20*d*. The development side toner agitating members and the others of the development device 14 are operated such that an amount of the toner just below the replenishment port 20*d* is larger than that in the other area. When the development device 14 consumes the toner, the toner is regularly replenished.

By the way, depending on a size tolerance or an assembling tolerance, a positional relationship between the development device 14 and the toner container 15 may be slightly displaced. In this case, the first rotation axis A1 of the development side joint 27 is not on the same axis line of the second rotation axis A2 of the case side joint 32 (is displaced parallel with the second rotation axis A2) (refer to FIG. 8).

As shown in FIG. 8, when the first rotation axis A1 is displaced in parallel with the second rotation axis A2, the engagement tip end 51*a* of the development side joint 27 is caught by an edge portion of the engagement recess 61*a* of the case side joint 32. That is, the engagement tip end 51*a* cannot be inserted into the engagement recess 61*a* smoothly. In this state, when the case side joint 32 is pressed toward the development side joint 27, the development side engagement member 51 is pressed by the case side engagement member 61 to compress the coil spring 52. Both of the pressing force of the case side joint 32 and the biasing force of the coil spring 52 make the development side engagement member 51 tilt in a direction in which the engagement tip end 51*a* is fitted into the engagement recess 61*a*. In this state, an axis direction A3 of the development side engagement member 51 is inclined with respect to the first rotation axis A1 and the second rotation axis A2.

As described above, the development side engagement member 51 is arranged in the inner space of the development side main body 50 in a state allowing the inclination with respect to the first rotation axis A1. Thereby, even in a state where the axis direction A3 of the development side engagement member 51 is inclined relative to each of the rotation axes A1 and A2, the engagement tip end 51*a* is fitted into the engagement recess 61*a* so as not to be rotatable. In this way, the case side joint 32 is coupled to the development side joint 27 so that the drive force of the drive motor 23 is transmitted to the conveying screw 31 from the drive shaft 24.

By the way, the case main body 30 of the toner container 15 of the present embodiment is formed by bonding the lid 34 to an upper side portion of the case 33 (refer to FIG. 5). More specifically, the lid side bonded area 45 of the lid 34 is overlapped on the case side bonded area 40 of the case 33 and then subjected to an ultrasonic welding. Thereby, the case 33 is sealed with the lid 34. Conventionally, an ultrasonic welding machine pinches the lid side bonded area 45 and the case side bonded area 40 in the vertical direction and then subjects them to an ultrasonic vibration to melt them and to bond them together. Accordingly, a space where the lid side bonded area 45 and the case side bonded area 40 are pinched in the vertical direction is secured.

In this point, according to the toner container 15 of the present embodiment, the rotator storage 43 and the joint storage 44 are formed on a position avoiding the lid side bonded area 45 within an area inside the circumferential edge of the lid main body 42 (refer to the dashed line in FIG. 4 and FIG. 5). The case side joint 32 is arranged on a position avoiding the lid side bonded area 45 by being stored in the joint storage 44 (refer to FIG. 6 and FIG. 7). Thereby, the bonding work of the lid side bonded area 45 to the case side bonded area 40 can be carried out appropriately.

In addition, because a bonding work area (refer to the dashed line in FIG. 5) is secured, it is not required to separate the case side joint 32 from the lid side bonded area 45 upward (a direction perpendicular to the second rotation axis A2). Accordingly, the second rotation axis A2 of the conveying screw 31 can be arranged in parallel with a part of the lid side bonded area 45 (refer to FIG. 7). Thereby, the gap G between the conveying screw 31 and the bottom face of the rotator storage 43 (the upper face of the connecting flange portion 41) can be kept constant so that the toner remained on the bottom face can be reduced remarkably.

The case side joint 32 is coupled to the conveying screw 31 by being inserted into the joint storage 44 and decoupled from the conveying screw 31 by being separated from the joint storage 44. Accordingly, the bonding work of the case 33 and the lid 34 can be carried out in a state where the case side joint 32 is pulled out from the joint storage 44. Then, after the bonding work, the case side joint 32 can be attached afterward to the conveying screw 31 by being inserted into the joint storage 44. In this way, because the case side joint 32 can be attached afterward, even if the case side joint 32 protrudes through the insertion opening 44*a*, the bonding work can be carried out appropriately.

The welding method of the case 33 and the lid 34 is not limited to the ultrasonic welding. For example, the welding method may be a heat welding in which the bonded areas 40 and 45 are made to come in contact with a heat source to be melted. In the toner supplying device 12 of the present embodiment, the drive shaft 24 of the development device 14 is on a driving side and the conveying screw 31 of the toner container 15 is on a driven side. The present disclosure is not limited to the present embodiment. For example, the conveying screw 31 may be driven to be rotated and a shaft driven by the conveying screw 31 may be provided in the development device 14.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body containing a toner supplied to a development device which includes a first rotator rotating around a first rotation axis;

a second rotator disposed inside the case main body and rotating around a second rotation axis extending in a direction along the first rotation axis; and a case side joint capable of coupling one end of the second rotator to an end of the first rotator, wherein the case main body includes:

a case including a case side bonded area formed around an outer circumference of an opening formed at one face of the case; and a lid including a lid side bonded area corresponding to the case side bonded area, the lid sealing the case in a state where the lid side bonded area is bonded to the case side bonded area, the lid has:

a lid main body including a circumferential edge around which the lid side bonded area is formed;

a rotator storage extending in a direction along the second rotation axis inside the circumferential edge of the lid main body, the rotator storage being capable of storing the second rotator; and a joint storage connected to one end of the rotator storage and formed inside the circumferential edge of the lid main body so as to avoid the lid side bonded area, the joint storage being capable of storing the case side joint, wherein a joint arrangement room in which the case side joint is arranged is formed inside the joint storage, and an upper face of the lid main body forms a bottom face of the joint arrangement room, wherein an insertion opening to open the joint arrangement room is formed on one end face of the joint storage, the case side joint is detachably coupled to the one end of the second rotator in a state where the case side joint is inserted into the joint arrangement room through the insertion opening, wherein the lid has a partition wall between the rotator storage and the joint storage, the partition wall has a through hole, the second rotator extends to an inside of the joint storage through the through hole.

2. The toner case according to claim 1, wherein the second rotator is a conveying screw which conveys the toner contained in the case main body toward the development device, the conveying screw is stored in the rotator storage in a posture in which the second rotation axis is parallel with a part of the lid side bonded area.

3. The toner case according to claim 1, wherein the case side joint has a case side hook elastically deformable in a direction crossing to the second rotation axis, the joint storage has a hook engagement portion with which the case side hook is engaged in a state where the case side joint is stored in the joint storage so that the case side joint is prevented from being detached from the joint storage.

4. The toner case according to claim 1, wherein the lid main body, the rotator storage and the joint storage are integrally formed.

5. A toner supplying device comprising:

the toner case according to claim 1; and the development device to which the toner is supplied from the toner case, wherein the development device includes a development side joint formed on the end of the first rotator, the case side joint and the development side joint are engaged with each other so that rotation is transmitted between the first rotator and the second rotator.

6. The toner supplying device according to claim 5, wherein the development side joint includes:

a development side main body rotatable integrally with the first rotator;

a development side engagement member extending closer to the case side joint than the development side main body, the development side engagement member being movable in a direction along the first rotation axis and inclinable relative to the first rotation axis; and a biasing member biasing the development side engagement member toward the case side joint, the case side joint includes:

a case side main body rotatable integrally with the second rotator; and a case side engagement member connected to one end of the case side main body, wherein the case side engagement member has an engagement recess opened at a side of the development side joint, the development side engagement member being detachably engaged with the engagement recess.

7. An image forming apparatus comprising the toner supplying device according to claim 5.

8. An image forming apparatus comprising:

the toner case according to claim 1; and an image forming part including the development device which forms a toner image by the toner supplied from the toner case.

9. The toner case according to claim 1, wherein the joint storage is formed into a substantially cylindrical shape extending in a direction along the second rotation axis.

10. The toner case according to claim 1, wherein the second rotator is separated from the first rotator.

* * * * *